United States Patent [19]

Von Muller

[11] Patent Number: 4,532,729

[45] Date of Patent: Aug. 6, 1985

[54] FIREARM MAGAZINE LOCK

[76] Inventor: Francis Von Muller, 153 State St., Brooklyn, N.Y. 11201

[21] Appl. No.: 483,782

[22] Filed: Apr. 11, 1983

Related U.S. Application Data

[63] Continuation-in-part of Ser. No. 183,426, Sep. 2, 1980, Pat. No. 4,384,420.

[51] Int. Cl.[3] ..... F41C 27/00; F41C 17/08

[52] U.S. Cl. ..... 42/1 LP

[58] Field of Search ..... 42/1 LP, 70 A

[56] References Cited

U.S. PATENT DOCUMENTS

| | | | |
|---|---|---|---|
| 2,945,316 | 7/1960 | Mulno | 42/1 LP |
| 3,018,576 | 1/1962 | Riechers | 42/1 LP |
| 3,089,272 | 5/1963 | McKinlay | 42/1 LP |
| 3,553,877 | 1/1971 | Welch et al. | 42/1 LP |
| 3,673,725 | 7/1972 | Cravener | 42/1 LP |
| 4,384,420 | 5/1983 | Von Muller | 42/1 LP |

*Primary Examiner*—Charles T. Jordan
*Attorney, Agent, or Firm*—Paul J. Sutton

[57] ABSTRACT

In firearms which have a removable magazine feed, provision is made to insert a key operated safety magazine unit which replaces the existing magazine unit. The safety magazine unit locks itself into the magazine well of the firearm when actuated by a removable key. Locking of the safety magazine unit prevents its removal from the magazine well of the firearm and replacement by a magazine with live ammunition. Locking of the safety magazine unit also immobilizes the firing mechanism of the firearm. Immobilization results from an internal blocking of the breech or bolt action necessary for the weapon to be opened or fired. Installation of a safety magazine unit completely immobilizes the firearm preventing its unauthorized firing. The safety magazine unit does not interfere with any of the weapon's inherent safety features.

6 Claims, 10 Drawing Figures

FIG. 1
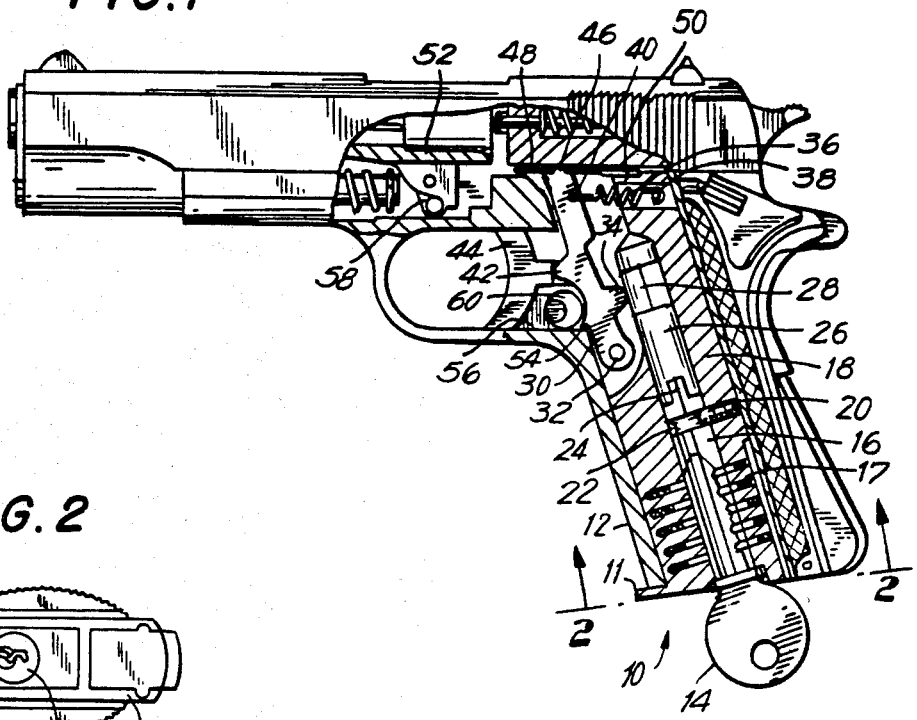
FIG. 2
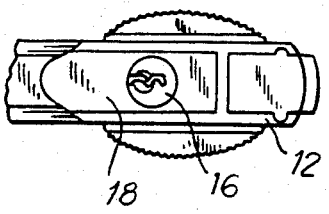
FIG. 3
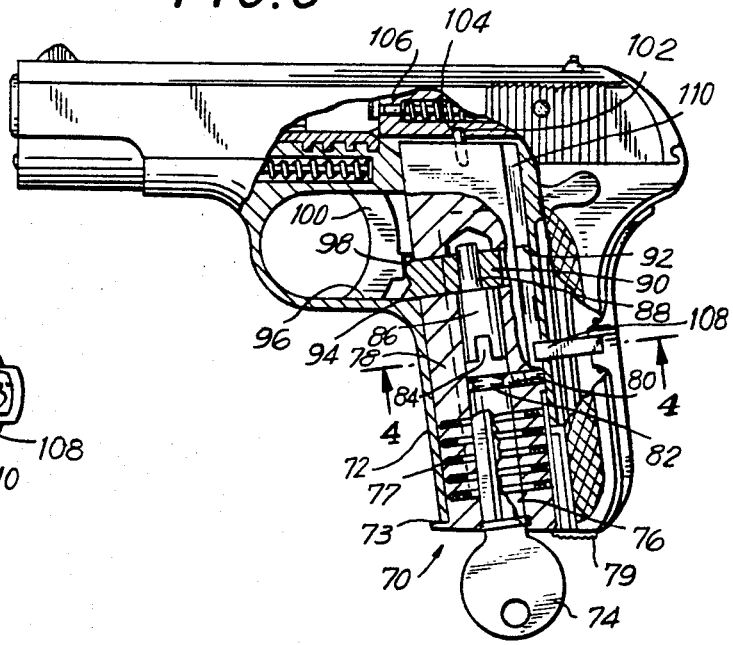
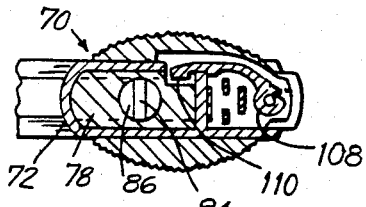
FIG. 4

FIG. 7
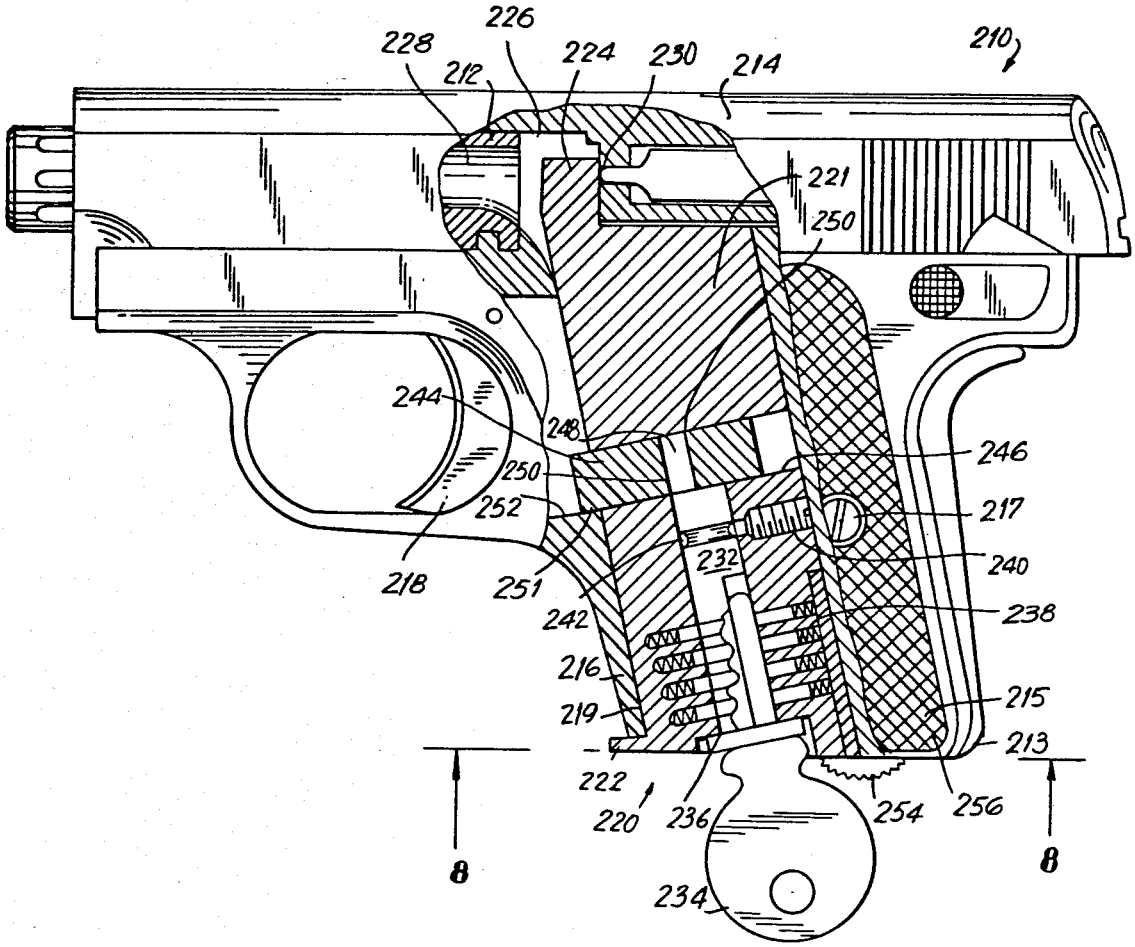
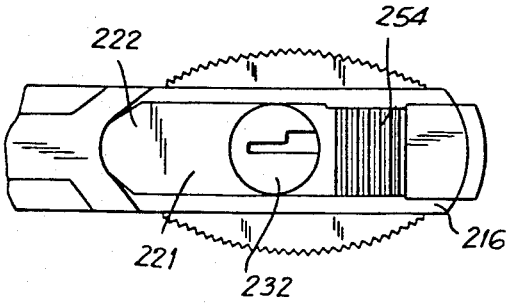
FIG. 8

FIREARM MAGAZINE LOCK

BACKGROUND OF THE INVENTION

The present application is a continuation in part of an application filed Sept. 2, 1980, Ser. No. 183,426, now U.S. Pat. No. 4,384,420.

The present invention relates to firearms. In particular the present invention relates to firearms which are provided with magazines which are removably connected to the firearm and are releasably held in position by a suitable retaining mechanism.

The safety and security of firearms has been a concern of military and civilian personnel for as long as firearms have been used. When firearms are stored or shipped it is desirable to prevent unauthorized use. When firearms are handled during instruction, placed on exhibition or used during parades it is necessary to ensure their safety.

DESCRIPTION OF PRIOR ART

Let us now look at certain prior art patents which, while not anticipatory of the present invention, disclose representative examples of previous or known efforts to solve some of the problems associated with the art embodying this invention.

U.S. Pat. No. 3,415,000 to Koucky discloses a catch lever 1 which is provided to prevent trigger member 12 from operating if magazine 2 is not in the firearm. This configuration does not prevent the unauthorized return of a loaded magazine to the firearm.

U.S. Pat. No. 3,715,826 to Seifried shows a ratchet 8 projecting into a groove 10A of a magazine 10. When magazine 10 is in the firearm and in the fully engaged position, the firearm can be fired. If a magazine 10 is removed or not fully engaged, the firearm cannot be fired. This arrangement can be easily bypassed if unauthorized use of the firearm is desired.

Thomas' U.S. Pat. No. 4,031,648 shows a trigger bar 34 which abuts trigger 32 and prevents actuation of firing pin 21 when magazine 83 is removed. This configuration again does not prevent unauthorized use of firearm.

While I do not wish to minimize the inventiveness and efforts of the inventors associated with the aforesaid and prior patents and while these people may be attempting to solve a problem similar to some of the problems solved by the present invention, it may be useful to comment on the aforementioned methods. The foregoing inventions address themselves to minimizing accidental discharge during firearm handling. In none of the foregoing devices is there any attempt to prevent unauthorized use of the firearm.

SUMMARY OF THE INVENTION

The primary object of the present invention is to provide a new and novel safety magazine unit for use with firearms having a detachable magazine feed.

Another object of this invention is to prevent firing of the last round in the chamber of a magazine fed firearm.

Still another object of this invention is to provide a safety magazine unit which to all outward appearances appears to carry live ammunition and is interchangeable with a standard magazine.

Yet another object of this invention is to provide a safety magazine which does not interfere with the conventional holstering or storage of the firearm.

A further object of this invention is to provide a simpler method for temporarily disabling target type pistols.

Still a further object of this invention is to provide a safety magazine which can be fitted to a firearm with no disassembly of the firearm.

BRIEF DESCRIPTION OF DRAWINGS

The foregoing and other objects, features and advantages of the present invention will become apparent from the detailed description herein after considered in conjunction with the accompanying drawings, wherein:

FIG. 1 is a plan fragmentary sectional view of an automatic pistol;

FIG. 2 is a view of FIG. 1 in the direction of arrows 2—2;

FIG. 3 is a plan fragmentary sectional view of a typical blowback operated automatic pistol;

FIG. 4 is a sectional view of FIG. 3 in the direction of arrows 4—4;

FIG. 7 is a partly sectioned side view of a typical blowback operated automatic pistol;

FIG. 8 is a view taken through line 8—8 of FIG. 7;

DETAILED DESCRIPTION OF PREFERRED EMBODIMENTS

Figure 5:
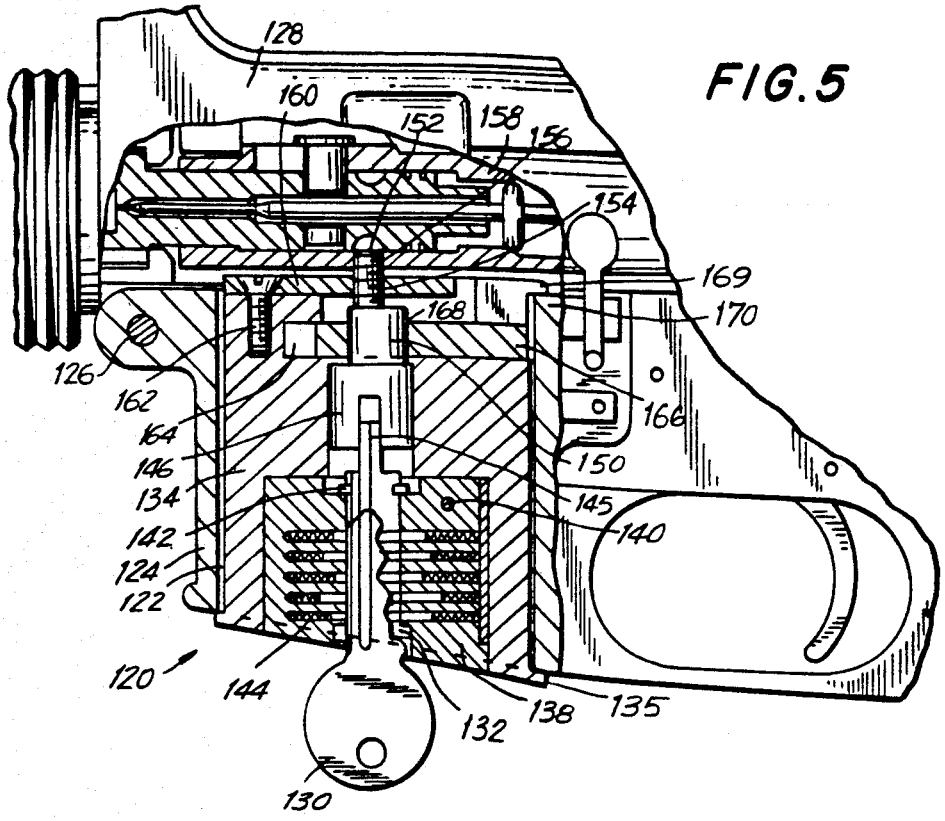
FIG. 5 is a plan fragmentary sectional plan view of an automatic rifle of the M16 design.

Referring now to FIG. 1, there is shown a fragmentary sectional view of an automatic pistol. Those items which are standard to the design of firearms marketed under the "Colt" name will not be described unless their description is necessary to the operation of this invention. This procedure will be followed with the other weapons described. The firearm shown in FIG. 1 is a first embodiment of the invention. A safety magazine, generally designated 10, is inserted into a receiver 12 which is part of the aforementioned firearm, a lip extension 11 limits entry of magazine 10. A key 14 (in the locked position) is shown inserted in a lock cylinder 16.

Lock cylinder 16 is retained in a safety magazine body 18 by a set screw 20 which engages a groove 22 in lock cylinder 16. Lock cylinder 16 also coacts with a pin assembly 17 to provide locking action. Lock cylinder 16 has a tongue 24 which engages a shaft 26 having means for receiving tongue 24. Shaft 26 and lock cylinder 16 are rotatably mounted and coaxial with each other. At the end opposite means for receiving tongue 24, shaft 26 has a cam 28 which is shown in contact with a cam lever 30. Cam lever 30 is restrained to move in a radial manner about a pivot pin 32 as can be seen in FIG. 1.

Cam lever 30 also has a cam contact surface 34 which is caused to be in contact with cam 28 by a spring 36. Spring 36 is attached to a portion of magazine safety body 18 by a pin 38 and is also attached to cam lever 30 at a hole 40. Cam lever 30 has a contact nose 42 which abuts the rear portion of a trigger 44. Trigger 44 is an existing part of the colt firearm. Proximate to contact nose 42 and midway between nose 42 and pin 32 is a wedge 54 which engages a trigger slideway 56, an existing feature of the aforementioned firearm. Cam lever 30 has at the end remote from pivot pin 32 a projection 46 which coactingly engages a slidable part 48. Slidable part 48 is slidably affixed to safety magazine body 18 by means not shown. A recess 50 permits slidable part 48 to fully retract thereby enabling removal of safety magazine unit 10 when unlocked. Also shown as an existing part of the aforementioned firearm is a link 58, a barrel 52 and a magazine release 60 which will be referred to later.

FIG. 2 is a view of FIG. 1 in the direction of arrows 2—2 and shows safety magazine unit 18 locked in place and giving the appearance of a conventional magazine clip inserted into receiver 12 of the firearm. Lock cylinder 16 is the only evidence that safety magazine unit 10 is unconventional.

Examination of FIG. 3 shows a fragmentary sectional view of a typical blowback operated automatic pistol of the pocket type. Here is shown a second embodiment of a safety magazine unit, generally designated 70 inserted into a receiver 72 which is part of the blowback operated pistol. Entry of magazine 70 into receiver 72 is limited by a lip extension 73.

A key 74 (in the locked position) is shown inserted in a lock cylinder 76. Lock cylinder 76 coacts with a pin assembly 77 to provide locking action. Lock cylinder 76 is retained in a safety magazine body 78 by a set screw 80 which engages a groove 82 in lock cylinder 76. Lock cylinder 76 can be seen to have a tongue 84 which engages a shaft 86 having means for receiving tongue 84. Shaft 86 and lock cylinder 76 are rotatably mounted and coaxial with each other. At the end opposite means for receiving tongue 84, shaft 86 has an eccentric pin 88 affixed to it. Eccentric pin 88 is received by a slide 90 which slidably moves in a a guideway 92 machined into safety magazine body 78. Slide 90 has at one end thereof a wedge 94 which engages a trigger slideway 96 which is an existing part of receiver 72 of the firearm shown in FIG. 3. Proximate to wedge 94 is a contact nose 98 which abuts a trigger 100 which is part of the presently described pistol. Affixed to safety magazine body 78, at the end opposite to key 74, is a pin 102 which fits into a drilled hole 104. Hole 104 is drilled in the underside of a pistol slide 106 which is part of the aforementioned blow back pistol. Toward the rear of the pistol's handle and midway between the top and bottom of the handle is a safety lever 108. Safety lever 108 is a safety provided by the pistol designers to prevent trigger 100 actuation when the magazine is removed. Magazine safety body 78 contains a channel 110, best seen in FIG. 4, which permits safety lever 108 to be operative when the pistol is used with safety magazine unit 70. Further, a standard magazine catch 79, part of the aforementioned pistol, is fully operative when safety magazine unit 70 is inserted.

Attention to FIG. 4 shows that it is a sectional view of FIG. 3 taken in the direction of arrows 4—4. FIG. 4 best shows channel 110 which is provided in safety magazine body 78 to clear safety lever 108. Also seen is tongue 84 and shaft 86.

FIG. 5 shows yet a third embodiment of the invention applied to an automatic rifle of the M16 type. A safety magazine unit, generally designated 120, shows how the third embodiment is practiced. Safety magazine unit 120 is shown inserted into a magazine well 122 which is part of a lower receiver 124 both being part of the aforementioned rifle. Lower receiver 124 is attached to an upper receiver 128 by means of a hinge pin 126 and a dismount pin (not shown) located at the rear of upper receiver 128, all the foregoing items are also part of the M16 rifle.

A key 130 (seen in the locked position) is shown inserted in a lock cylinder 132. Lock cylinder 132 is retained in a lock cylinder carrier 138 by a lock collar 142. Lock cylinder carrier 138 is affixed to a safety magazine body 134 by a pin 140.

A pin tumbler assembly 144 is provided to make possible a large number of key 130 combinations. Lock cylinder 132 is seen to have a tongue 145 which slidably engages a shaft 146 having means for slidably receiving tongue 145. Shaft 146 and lock cylinder 132 are rotatably mounted and coaxial with each other. At the end opposite means for receiving tongue 145, shaft 146 has affixed an eccentric boss 150. Affixed to the upper end of boss 150 is a multiple lead screw 152 concentric with shaft 146. Multiple lead screw 152 is shown passing through a multiple threaded guide hole 154 and thence into a multiple threaded locking hole 156. Multiple thread locking hole 156 is drilled and tapped in a rifle bolt carrier 158, said carrier being part of the aforementioned rifle. A guide plate 160 contains guide hole 154 and serves as an alignment device for multiple lead screw 152. Guide plate 160 is affixed to magazine safety body 134 by means of a screw 162 which maintains alignment of guide hole 154 with locking hole 156.

Magazine safety body 134 contains a slideway 164 which slidably supports a latch 166 having an opening 168 for coacting with eccentric boss 150. Latch 166 has a catch 169 which protrudes over a rear wall 170 of magazine well 122. Magazine body 134 is seen to have a magazine lip extension 135 which abuts the bottom of magazine well 122 and limits the entry of magazine safety body 134 into lower receiver 124.

Figure 6:
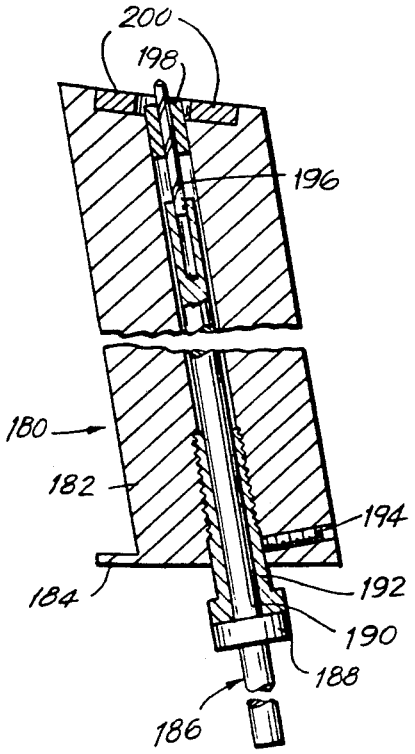
FIG. 6 is a plan sectional view of a typical drilling unit.

FIG. 6 illustrates a typical drilling unit generally designated 180, which is used to spot and drill the hole which mates with the pin or screw of the particular safety magazine unit selected for use with the firearm being fitted.

Drilling unit 180 consists of a drilling unit body 182 having a lip extension 184 for limiting the entry of drilling unit 180 into the firearm receiver. Drilling unit 180 readily interchanges with the regular firearm magazine. Assembled into drilling unit body 182 is a drilling assembly 186 consisting of a limiting collar 188 affixed to a shaft 190 which is closely fitted to a drill guide bushing 192 threaded into body 182. Guide bushing 192 is affixed to body 182 by a set screw 194. Brazed onto shaft 190 and coaxial with it is a drill 196 which is contained in drill guide bushing 198, also coaxial with shaft 90. Imbedded in the top surface of body 182 is a set of bar magnets 200 which attract drill chips to itself.

OPERATION OF PREFERRED EMBODIMENTS

The operation of making safe the automatic pistol, shown in FIG. 1 by installation of safety magazine unit 10 requires the user to first unload the firearm. Unloading is accomplished by removing the magazine, opening the action to remove a round from the chamber if necessary, and then closing the action and placing the hammer in the down position. After magazine safety unit 10 is verified to be in the unlocked state, it is inserted into receiver 12, and the standard magazine release 60, part of the firearm, will function to retain magazine safety unit 10 in place.

Key 14 is then inserted and rotated 180 degrees which causes lock cylinder 16 to rotate shaft 26. Rotation of shaft 26 causes cam 28 to contact cam surface 34 and rotate cam lever 30 into the locked position as shown in FIG. 1. When cam lever 30 assumes a locked position, contact nose 42 abuts the rear portion of trigger 44, thereby preventing its movement. Wedge 54, also part of cam lever 30 abuts the trigger slideway 56, and provides locking action which prevents removal of safety magazine unit 10. Cam lever 30 also has attached to its upper end slidable part 48, which moves forward into the gap between the rear underside of the barrel 52 and the top of the receiver 12. With slidable part 48 in this position, barrel 52 is prevented from moving downward on its link 58, as normally occurs during unbreeching, thereby locking the action of the pistol closed and making the introduction of ammunition impossible. Key 14 can then be removed from lock cylinder 16 and stored in a safe place.

Making safe the typical blow back automatic pistol, such as shown in FIG. 3, is accomplished by first removing its magazine from the receiver 72, and then unloading the firing chamber. Upon removal of its magazine from the weapon, safety lever 108 is actuated and the pistol is secured against discharge. Magazine safety unit 70, designed for use with this particular weapon, incorporates channel 110, best seen in FIG. 4, which clears safety lever 108 enabling it to remain operative. After magazine safety unit 70 is verified to be in the unlocked state, it is inserted in receiver 72 until lip extension 73 abuts the bottom of the receiver 72. In this position the standard magazine catch 79 of the pistol will function to retain the magazine safety unit 70 in place.

Key 74 is then inserted and rotated 180 degrees which causes lock cylinder 76 and shaft 86 with eccentric pin 88 to rotate a likewise amount, causing slide 90 to extend from magazine body 78. This motion of slide 90 causes contact nose 98 to abut the rear portion of trigger 100 and wedge 94 to abut the lower surface of the trigger slideway 96, as shown in FIG. 3. Contact nose 98 thus prevents trigger 100 from being pulled and wedge 94 blocks removal of magazine safety unit 70 from the weapon. Pin 102 is now also inserted in drilled hole 104 and thereby prevents slide 106 from being opened and the weapon loaded with ammunition. Key 74 can then be removed from lock cylinder 76 and stored in a safe place.

The rifle shown in FIG. 5 is prepared in the following manner. The magazine is removed, chamber unloaded, and bolt carrier closed. Magazine safety unit 120 is first verified to be in the unlocked position and then inserted in magazine well 122 of the firearm until extension lip 135 abuts the lower receiver 124, at which position the standard magazine catch of the weapon will function to retain the magazine safety until 120 in place in the rifle. Key 130 is then inserted in lock cylinder 132 and turned 180 degrees, which causes shaft 146 with eccentric boss 150 to also rotate and force slide 166 to move rearward in the gun, latching catch 169 over the top of rear magazine well wall 170. The preceding action causes the magazine safety unit 120 to be securely locked to the lower receiver 124, preventing its removal and replacement with a loaded magazine. As key 130 is rotated it also causes multiple lead screw 152 to advance upward, guided by guide hole 154, and enter locking hole 156 in rifle bolt carrier 158. Multiple lead screw 152 offers maximum engagement with locking hole 156 on rotation of key 130, although this invention is not limited to this arrangement. The entry of multiple lead screw 152 in the rifle bolt carrier 158 simultaneously locks the weapons breech closed and clamps the upper receiver 128 and lower receiver 124 together, thus eliminating all possibility of the insertion of live ammunition. Key 130 may now be removed and stored in a safe place.

While it is intended that my invention be applied to the manufacture of firearms so that each magazine loaded firearm be made available with a magazine safety unit as an accessory, my invention is also applicable to firearms which have been manufactured and are presently in use.

The following description applies to the retrofitting of existing firearms with my invention.

In the case of most existing blowback type automatic pistols it is necessary to predrill a hole 104 in the underside of the pistol slide 106 to accommodate pin 102 of the magazine safety unit 70 as shown in FIG. 3. To facilitate the drilling of this hole without disassembly of the pistol or use of complicated machinery, there has been provided a drilling unit 180 as shown in FIG. 6. The drilling unit 180 has been designed to properly fit the magazine well of each type of firearm to be retrofitted, replacing its regular magazine. By inserting drilling unit 180 and powering drilling assembly 186 by means of an electric drill or equivalent, the required hole may be easily drilled in the slide of a pistol, or in the bolt carrier of a rifle. The exact depth of the required hole is attained in the drilling operation when limiting collar 188 impinges on the bottom surface of guide bushing 192 as shown in FIG. 6. Bar magnets 200 serve to attract and hold drill chips generated during the drilling operation to prevent entrance of the drill chips into the mechanism of the firearm.

The locking hole required for magazine loading rifles such as that shown in FIG. 5 may be produced by a suitably dimensioned drilling unit functionally equivalent to that used with the blowback pistol. Two such units would be required, one for drilling and one for threading. The conversion of a large number of weapons would best be handled by the application of production machinery methods directly to the parts involved.

A fourth embodiment of the present invention is illustrated in FIGS. 7 and 8.

FIG. 7 illustrates a partially sectioned elevational view of a typical blowback operated automatic pistol 210 including the barrel 212, pistol slide 214, the bottom frame, or receiver, 216, including grip 213 with checked stock 215 secured to the grip by screw 217, and trigger 218. In accordance with the present invention, a safety magazine unit generally designated as 220 is inserted into a magazine well 219 formed in receiver 216. Safety magazine unit 220 replaces the standard cartridge carrying magazine. Safety magazine unit 220 includes magazine body 221. A lip 222 formed at the bottom forward portion of magazine body 221 limits the entry of magazine body 221 into receiver 216. A lug 224 integral with magazine body 221 formed at the top forward portion of magazine body 221 extends into a space 226 formed between firing chamber 228 at the rear end of barrel 212 and breech face 230 positioned at the center portion of slide 214. Lug 224 also acts to hole slide 214 back a short distance from the closed position which is that position breech face 230 contacts at the rear end of barrel 212.

A lock cylinder 232 is positioned at the bottom portion of magazine body 221 and cylinder key 234 is shown inserted upwards into keyway 236 and interacting with pin tumbler set 238 of cylinder 232. Lock cylinder 232 is retained in magazine body 221 by a set screw 240 that extends transversely across the rear portion of magazine body 221 and further extends into circular groove 242 cut in the upper part of cylinder 232. A cross-bar, or slide lock 244, is slidably mounted in transverse slideway 246 formed across magazine body 221 directly above the top of cylinder 232. An eccentric pin 248 extending upwardly from the top side of cylinder 232 is engaged in slot 250 formed in the midportion of slide lock 244. Slide lock 244, which is slidably controlled by eccentricpin 248, is capable of movement between a rearward position where slide lock 244 is contained within magazine body 221 and a forward position, as shown in FIG. 7, where the nose portion 251 of slide lock 244 protrudes from the front side of magazine body 221 into trigger slideway 252 formed in receiver 216 rearwardly of trigger 218. A catch 254 connected to the bottom of receiver 216 is biasedly rotatable to a locked position where it is positioned under the bottom of magazine body 221 so that magazine body 221 is kept in place in receiver 216 when key 234 is rotated to actuate pin tumbler set 238 of cylinder 232 between locked and unlocked positions. Catch 254 is movable to an open position to allow removal of safety magazine unit 220.

FIG. 8 shows the face of butt 256 of pistol grip 213 with magazine safety unit 220 installed in pistol 210. Key 234 has been actuated and removed and catch 254 has been slid into its locked position keeping magazine unit 220 in place in receiver 216 before slide lock 244 is permitted to be actuated in slideway 246 by cylinder 232.

The operation of installing a safety magazine unit 220 begins with the unloading of pistol 210 and the removal of the standard magazine (not shown). Safety magazine unit 220 is verified to be in its unlocked mode with slide lock 244 with its nose portion 251 in its withdrawn position into magazine body 221. Then safety magazine unit 220 is inserted into magazine well 219 into receiver 216 to approximately three-quarters of its length. Next, pistol slide 214 is pulled back about a quarter of the way toward its rearmost position, and magazine safety unit 220 is thereupon seated to its full length into magazine well 219, which position can be verified by the contact of lip 222 with the face of butt 256 and the snapping close of magazine catch 254. Pistol slide 214 is then released so that breech face 230 is pressed against lug 224 of magazine body 221.

Key 234 is then inserted into keyway 236 of lock cylinder 232 and upon interaction with pin tumbler set 238 is rotated about 180 degrees. Rotation of lock cylinder 232 causes eccentric pin 248 to rotate in slot 250 and to cam slide lock 244 in slideway 246 towards the front of pistol 210. This movement of slide lock 244 causes nose portion 251 of slide lock 244 to enter trigger slideway 252, thus locking magazine safety unit 220 within receiver 216. At the same time, lug 224 of safety magazine unit 220 is interposed between firing chamber 228 and breech face 230. Key 234 can now be removed from magazine safety unit 220 and stored in a safe place. The firearm is now completely secured against unauthorized loading and firing because lug 224 prevents the introduction of ammunition into firing chamber 228, and because safety magazine unit 220 cannot be removed from the weapon to insert a standard magazine containing cartridges.

Figure 9:
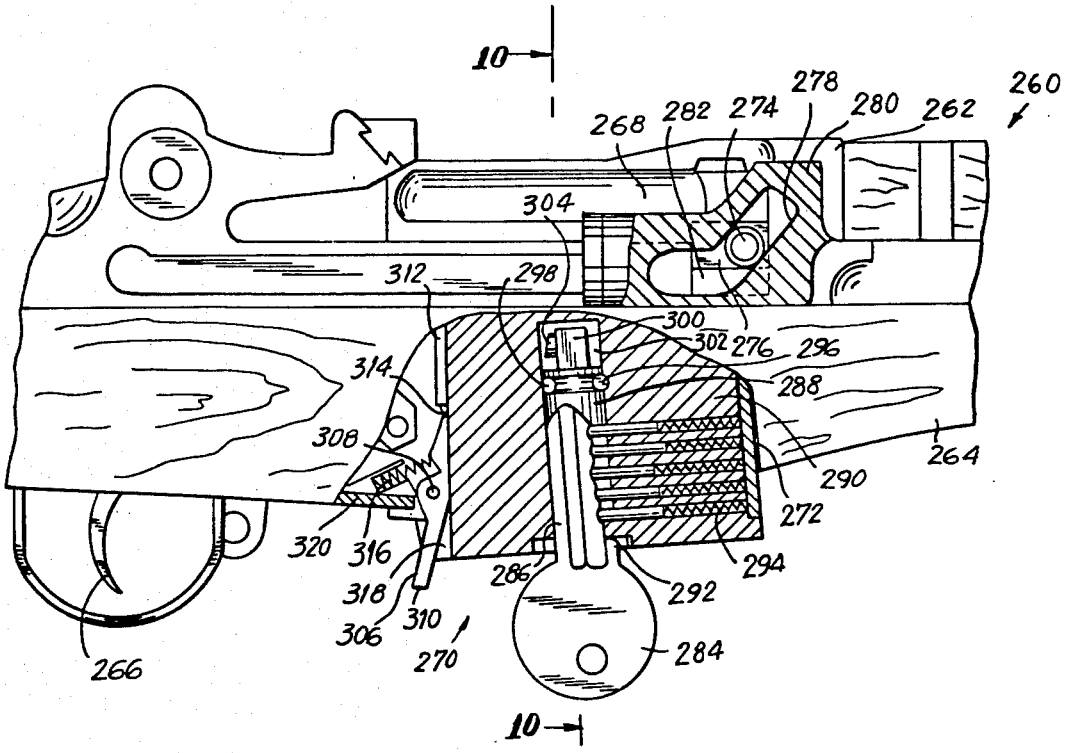
FIG. 9 is a fragmentary partly sectioned side view of an automatic rifle of M14 design.
Figure 10:
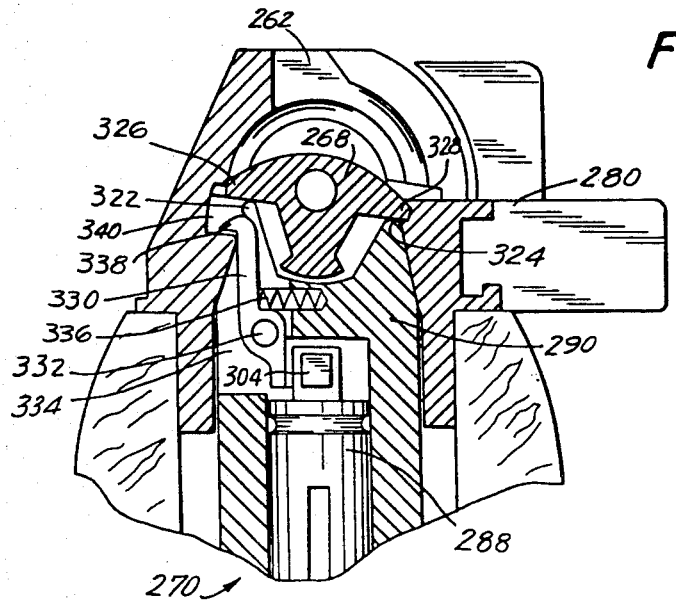
FIG. 10 is a view taken through line 10—10 of FIG. 9.

A fifth embodiment of the invention is illustrated in FIGS. 9 and 10 as applied to an automatic rifle. In particular, an automatic rifle 260 of the M14 type is shown in a sectional partial right side view in FIG. 9 including a portion of the fixed receiver 262, a portion of the wood stock 264, the trigger 266, and a portion of the bolt 268. In accordance with the present invention, a safety magazine unit 270 is shown inserted into magazine well 272 formed in receiver 262 replacing a standard magazine (not shown). Bolt 268 is held fixed in receiver 262 at an angular position approximately midway in its normal 25 degree rotational unlocking angle. This position is accomplished by safety magazine unit 270 in a manner to be described in the course of this disclosure. When bolt 268 is in the position just described, a roller stud 274 extending horizontally outwards from the bolt lug 276 connected to bolt 268, is positioned approximately halfway up camway 278 formed in operating slide 280, which in turn is slidably mounted to receiver 262 in a known manner. Operating slide 280 is shown in partial section in FIG. 9 for purposes of clarity. Also, bolt lug 276 integral with bolt 268, held in position is approximately halfway out of bolt lug recess 282. In a normal firing cycle, operating slide 280 moves toward the rear of rifle 260 causing the camming of roller stud 274 to the top of camway 278 and raising bolt lug 276 completely out of bolt lug recess 282.

Key 284 is shown in FIG. 9 inserted into keyway 286 of lock cylinder 288, which is mounted in magazine body 290 of safety magazine unit 270 with cylinder face 292 positioned at the bottom side of the magazine body 290. A pin tumbler set 294 is positioned in magazine body 290 and extends into lock cylinder 288. A circular groove 298 is formed around the periphery of cylinder 288 above pin tumbler set 294 and a crosspin 296 extends transversely through magazine body 290 and one side of groove 298 so as to fix cylinder 288 in magazine body 290 and at the same time allow cylinder 288 to be rotatable with the magazine body. A finger 300 extends upward from the top end of cylinder 288 into a recess 302 formed in magazine body 290 over cylinder 288. A stud 304 extends from the top side of finger 300 within recess 302. Stud 304 rotates with cylinder 288 to actuate elements to be described later. A magazine release 306 is rotatably fixed to pin 308, which is connected to a portion of firing mechanism 320 that is in assembly with receiver 262 in a known manner. Magazine release 306 includes an opposing butt end 310 and a gripping end 314. Gripping end 314 in its locked mode as shown in FIG. 9, adjoins the bottom end of rib 312, which is connected to the rear wall of magazine body 290. Butt end 310 extends below stock 264 so as to be adapted for pressing forward to rotatably unlock magazine release 306 from its locked mode against rib 312. An expansion spring 316 is connected at one end to firing mechanism 320 in a known manner and at its opposite end expansion spring 316 biases gripping end 314 against magazine body 290 under rib 312 so that magazine body 290 is retained in magazine well 272 in the same manner a standard magazine is retained. A blocking lug 318 connected to the bottom rear portion of magazine body 290 contacts the underside of firing mechanism 320 forward of trigger 266 so as to limit the entry of safety magazine unit 270 in magazine well 272.

As seen in FIG. 10, an opposed pair of left and right lugs 322 and 324 respectively extend upwards from opposite sides of the top of magazine body 290 and bear against the undersides of opposed left and right flanges 326 and 328 respectively of bolt 268 holding it in the angular position previously described, namely, approximately halfway of its normal 25 degree rotational unlocking angle. This is accomplished by way of left lug 322 being extended a greater distance from the top of magazine body 290 than right lug 324 so that bolt 268 is tilted at the desired angle.

As also illustrated in FIG. 10, a latch 330 is rotatably mounted to the left side of magazine body 290 by way of pin 332, which is longitudinally fixed within left recess 334, which is formed at the top left portion of magazine body 290 and connects to recess 302 in which stud 304 is contained. An expansion spring 336 mounted in the top left portion of magazine body 290 engages latch 330 and biases latch catch 338 into engagement with bolt lug slideway 340 of receiver 262. When key 284 is rotated clockwise in cylinder 288 when viewed from the topside so that cylinder 288 is likewise rotated clockwise, stud 304 is rotated into contact with the bottom end of latch 330 thus causing the latch to rotate clockwise when viewed from the rear of rifle 260 and as viewed in FIG. 10, and latch catch 338 withdraws from its locked position in bolt lug slideway 340.

The operation of safety magazine unit 270 is as follows: rifle 260 is prepared for use with magazine safety unit 270 by first unloading the rifle and removing the standard magazine. Operating slide 280 is then pulled rearwardly until roller stud 274 is cammed, or forced, by camway 278 to rotate bolt 268 to the position illustrated in FIG. 9, namely, about halfway through its 25 degrees rotational unlocking range. At this position of bolt 268, safety magazine unit 270, with key 284 removed, is inserted in magazine well 272 until blocking lug 318 contacts firing mechanism 320. Operating slide 280 is then released. At the time safety magazine unit 270 is fully inserted into magazine well 272, left and right lugs 322 and 324 of magazine body 290 bear against the undersides of left and right flanges 326 and 328 of bolt 268 as shown in FIG. 10. Bolt 268 is now immobilized in the midway position of its normal 25 degree unlocking rotation. At the same time, with safety magazine unit 270 properly seated in magazine well 272, latch 330 is biased by expansion spring 336 and pivots on pin 332 to engage with bolt lug slideway 340 of receiver 262, thus anchoring safety magazine unit 270 into position in magazine well 272. Rifle 260 has now been made safe against unauthorized loading or firing. This result follows because bolt lug 276 of bolt 268 is prevented from completely rising out of bolt lug recess 282, thus locking operating slide 280 in position because of the engagement of camway 278 with non-moving roller stud 274. For this same reason, bolt 268 cannot be completely closed to the locked breech position.

With operating slide 280 immobilized, the breech of the weapon cannot be opened to introduce ammunition. In addition, safety magazine unit 270 cannot be removed and replaced with a loaded standard magazine. It is important to note that if bolt 268 could be opened, safety magazine unit 270 would be exposed to simple forcible removal. Also, because bolt 268 cannot be fully closed, a discharge of a cartridge inadvertently left in the firing chamber is not possible. In addition, blocking lug 318, which limits the entry of safety magazine unit 270 into well 272, also serves to block removal of firing mechanism 320, thereby preventing disassembly of the firearm.

Removal of safety magazine unit 270 from magazine well 272 is accomplished by inserting key 284 into lock cylinder 288. After key 284 interacts with pin tumbler set 294, the key is turned approximately 90 degrees thus rotating cylinder 288 90 degrees, which action causes stud 304 also to rotate 90 degrees with the result that the stud 304 bears against the lower end of latch 330. This pressure causes latch 330 to rotate clockwise about pin 332 as viewed from the rearward side of the rifle as seen in FIG. 10 and to disengage latch catch 338 from bolt lug slideway 340, thus freeing safety magazine unit 270 for removal from the weapon. Actuation of magazine release 306 will disengage the release from rib 312 and allow complete removal of safety magazine unit 270 from the rifle.

The embodiments of the invention particularly disclosed and described herein are presented merely as examples of the invention; other embodiments, forms, and modifications of the invention coming within the proper scope and spirit of the appended claims will of course readily suggest themselves to those skilled in the art.

I claim:

1. In a firearm having receiving means for removably receiving a magazine containing cartridges, loading means for loading said cartridges in a firing chamber and trigger means for firing said cartridge, wherein the improvement comprises:

(a) a member adapted for use with said receiving means, and (b) a means for coacting with said loading means in order to prevent operation of said firearm when said member is in said receiving means, said means for coacting with said loading means further comprising a means for locking said member into said receiving means in order to prevent removal of said member, said means for locking further comprising a lock means for preventing operation of said means for locking, said member including means for coacting with said trigger means in order to further prevent operation of said firearm when said member is in said receiving means.

2. In a firearm of claim 1 wherein:

said receiving means is part of a rifle, said means for coacting with said loading means is a multiple lead screw which engages a bolt portion of said loading means, said means for locking said member comprises a latch means adapted for releasable engagement with said receiving means, and said lock means is a pin operated tumbler lock.

3. In a firearm of clam 1 wherein:

said receiving means is a part of an automatic pistol, said means for coacting with said loading means is a slidable part, said means for locking said member comprising a cam lever engaging a trigger slideway portion of said pistol, said lock means comprises a pin operated tumbler lock, and said further means for coacting with said trigger means is an abutting portion of said cam lever.

4. In a firearm of claim 1 wherein:

said receiving means is part of a blowback operated pistol, said means for coacting with said loading means is a pin for releasably engaging said loading means, said means for locking said member comprises a slide engaging a trigger slideway portion of said blowback pistol, said lock means comprises a pin operated tumbler lock, and said further means for coacting with said trigger means is an abutting portion of said slide.

5. In a firearm of claim 1, wherein:

said receiving means is part of an automatic rifle said means for coacting with said loading means is a pair of lugs which engage flanges of a bolt of said loading means, said means for locking said member comprises a latch adapted for releasable engagement with a bolt lug slideway of said receiving means, and said lock means is a pin operated tumbler lock.

6. In a firearm of claim 1 wherein:

said receiving means is part of a blowback operated pistol, said means for coacting with said loading means is a lug for releasably engaging said loading means, said means for locking said member comprises a slide engaging a trigger slideway portion of said blowback pistol, and said lock means comprises a pin operated tumbler lock.

* * * * *